US007278387B2

(12) United States Patent
Gong et al.

(10) Patent No.: US 7,278,387 B2
(45) Date of Patent: Oct. 9, 2007

(54) MULTIPLE SPARK PATTERN INTERNAL COMBUSTION INITIATION DEVICE AND ENGINE USING SAME

(75) Inventors: Weidong Gong, Dunlap, IL (US); Scott Fiveland, East Norwich, NY (US); Brett Bailey, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/335,978

(22) Filed: Jan. 20, 2006

(65) Prior Publication Data

US 2007/0169737 A1 Jul. 26, 2007

(51) Int. Cl.
*H01T 13/46* (2006.01)
*H01T 13/54* (2006.01)

(52) U.S. Cl. ..... 123/169 MG

(58) Field of Classification Search ..... 123/37, 123/627, 636, 638, 640, 169 MG, 260
See application file for complete search history.

(56) References Cited

U.S. PATENT DOCUMENTS 1,551,172 A * 8/1925 Ritchey ..... 313/137
2,866,447 A * 12/1958 Kaehni ..... 123/260
4,004,562 A * 1/1977 Rado et al. ..... 123/169 MG
4,041,922 A * 8/1977 Abe et al. ..... 123/260
4,059,079 A * 11/1977 Kasima et al. ..... 123/260
4,133,330 A 1/1979 Nakajima et al.
4,305,357 A * 12/1981 Scherenberg et al. ..... 123/254
4,987,868 A * 1/1991 Richardson ..... 123/260
5,003,945 A 4/1991 Hoeptner
5,074,262 A * 12/1991 McAbee et al. ..... 123/169 MG
5,105,780 A 4/1992 Richardson
5,430,346 A 7/1995 Johnson
5,554,908 A * 9/1996 Kuhnert et al. ..... 313/140
5,947,076 A 9/1999 Srinivasan et al.
7,082,920 B2 * 8/2006 Robinet et al. ..... 123/260

OTHER PUBLICATIONS

Multitorch-Prechamber Spark Plugs For Lean Bum Otto —Gas —Engines: Technical Information No. 470110A: pp. 1-15.

* cited by examiner

*Primary Examiner*—Mahmoud Gimie
(74) *Attorney, Agent, or Firm*—Liell & McNeil

(57) ABSTRACT

A multiple spark pattern internal combustion initiation device includes a body defining a prechamber and a plurality of orifices from the prechamber. The device includes at least two electrical circuits which each form a spark gap with an electrical ground inside the prechamber, operable to create a plurality of different spark patterns. The device may be part of an internal combustion engine which includes a housing with a combustion chamber connected to the prechamber, and means for supplying a lean gaseous fuel mixture into the combustion chamber.

17 Claims, 3 Drawing Sheets

MULTIPLE SPARK PATTERN INTERNAL COMBUSTION INITIATION DEVICE AND ENGINE USING SAME

TECHNICAL FIELD

The present disclosure relates generally to spark-ignited internal combustion initiation devices and methods, and relates more particularly to such a device having multiple spark patterns and an internal combustion engine using the same.

BACKGROUND

One method of operating internal combustion engines consists of supplying gaseous fuel into a combustion chamber, adding air to get a particular air to fuel ratio (AFR), and then igniting the mixture, typically with a spark from a sparkplug in a conventional manner known to those skilled in the art. If this ignition is done with a relatively low AFR, then the resulting combustion tends to occur very quickly, and at a very high temperature. This can result in the formation of nitrogen-oxygen compounds (NOx).

One method of reducing the formation of NOx is thus to use a higher AFR or otherwise lean mixture, which results in a slower burn at a lower temperature. However, spark ignition becomes more difficult as the amount of fuel per unit volume decreases. Additionally, small scale turbulence in the spark gap makes the formation of suitable ignition sparks difficult. The increasing use of recirculated exhaust gas to affect the relative "richness" or "leanness" of the overall mixture has created additional challenges to igniting mixtures in the cylinders as desired.

Several methods have been developed in response to the difficulties encountered in attempting to run gaseous engines via lean burn strategies, such as an AFR on the order of 68:1. One method is to use a prechamber and sparkplug. A typical prechamber and sparkplug configuration includes at least one orifice leading to the combustion chamber. A spark gap is positioned inside the prechamber, and attached to an electrical lead. Because of the small size and relative isolation of the prechamber, turbulence in the fuel and air mixture therein is significantly reduced, facilitating the formation of sparks and flame generation. A spark arcs across the spark gap and ignites a combustion reaction inside the prechamber. The prechamber combustion propagates and expels a jet(s) of burning gas through the orifice(s) into the combustion chamber of the engine, which serves to ignite the main fuel charge in the combustion chamber. More recent designs will have more than one orifice so the flame will propagate on multiple fronts simultaneously, resulting in more efficient ignition. The art teaches different models for such sparkplugs such as U.S. Pat. Nos. 5,947,076 and 4,987,868. There are also examples of designs which attempt to increase the efficiency of the prechamber such as U.S. Pat. No. 5,105,780.

At specific conditions the internal combustion initiation device is optimally efficient, but as the AFR varies with engine operating condition, the efficiency of the engine may be reduced. This can result in the fuel burning too quickly, which results in increased temperature and increased NOx output, or the fuel incompletely burning which results in unburned hydrocarbons in the exhaust. While the most advanced of these prechamber sparkplugs enable a broader range of AFR's for a given engine than formerly available designs, there remains room for improvement.

The present disclosure is directed to one or more of the problems or shortcomings set forth above.

SUMMARY OF THE INVENTION

In one aspect, this disclosure provides an internal combustion initiation device having a body that defines a prechamber and a plurality of outlet orifices. Further, there is a first spark gap at a first position inside the prechamber, and a second spark gap at a second position inside the prechamber. The first spark gap and the second spark gap are coupled to a first electrical circuit and a second electrical circuit, respectively.

In another aspect, this disclosure provides an internal combustion engine comprising a housing including at least one combustion chamber, and further including an internal combustion initiation device attached to the engine housing. The device includes a plurality of orifices that open from a prechamber and fluidly connect with the combustion chamber. Further, the device includes means for initiating at least two different spark patterns in the prechamber.

In yet another aspect, this disclosure provides a method of operating an internal combustion engine comprising the steps of supplying fuel to a combustion chamber of the engine. One of a plurality of different spark patterns is selected, and the fuel is ignited at least in part by activating the selected spark pattern inside of a prechamber fluidly connected with the combustion chamber.

DETAILED DESCRIPTION

Figure 1:
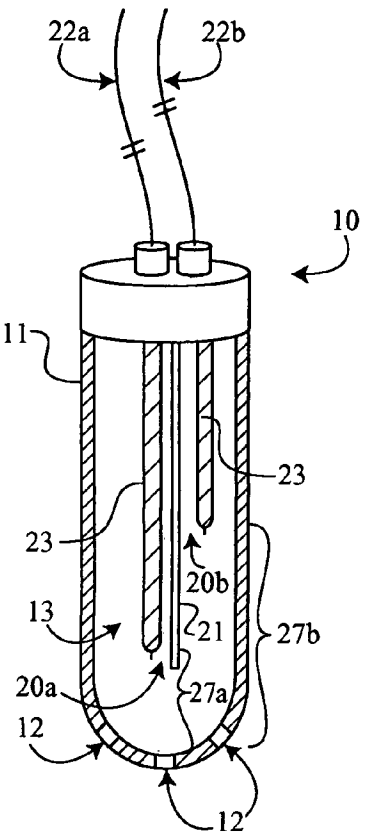
FIG. 1 is a diagrammatic side view of an internal combustion initiation device according to the present disclosure.

Referring to FIG. 1, there is shown an internal combustion initiation device 10 according to the present disclosure, which includes an internal combustion initiation device body 11 defining a prechamber 13 and a plurality of orifices 12. Inside the prechamber 13 are a first spark gap 20*a*, and a second spark gap 20*b*. The first spark gap 20*a* is at a first distance 27*a* from the orifice 12, and is part of a first electrical circuit 22*a* that extends into the prechamber 13 next to an electrical ground 21. The length of the electrical circuit 22*a* is covered by insulation 23 with the exception of the first spark gap 20*a* formed by the first electrical circuit 22*a* and the electrical ground 21. In a similar manner the second spark gap 20*b* is at a second distance 27*b* from the orifice 12, and is part of a second electrical circuit 22*b* which is covered in insulation 23, and connects with electrical ground 21. Selective activation of one of the spark gaps allows the effective prechamber volume to be varied, as described herein.

Figure 2:
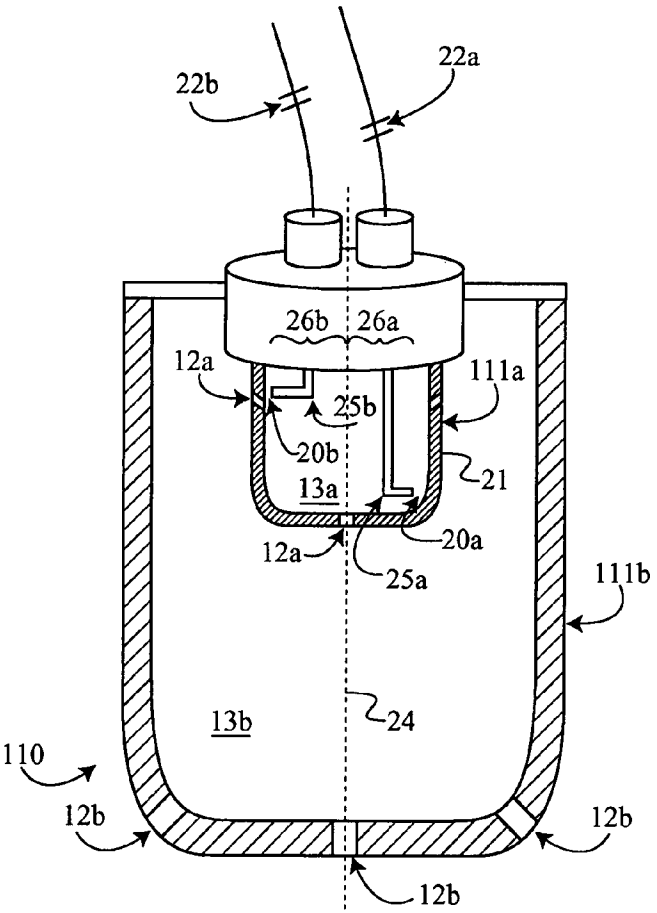
FIG. 2 is a diagrammatic side view of an alternative embodiment of an internal combustion initiation device according to the present disclosure.

FIG. 2 shows a different configuration of an internal combustion initiation device 110 according to the present disclosure where certain similar elements are assigned similar numbers to the other Figures. Device 110 differs from device 10 of FIG. 1 in that it includes an inner body portion 111*a*, and an outer body portion 111*b* nested with inner body portion 111*a*. In this embodiment, the electrical ground 21 may be a portion of inner body portion 111*a*. Those skilled in the art will appreciate that the electrical ground might be the engine head or some other engine component. Further, in such an embodiment the prechamber itself might be part of the head, etc. In addition, the electrical circuits, and respective portions extending into the prechamber need not be as long as in certain other embodiments of the present disclosure. The illustrated design may be well suited to certain environments, such as particular engine configurations.

The first electrical circuit 22*a* enters a first prechamber 13*a* parallel to the centerline 24. At a first position 25*a* the first circuit 22*a* bends and extends perpendicular to the centerline 24 until it reaches a first radius from the centerline 26*a*. The first spark gap 20*a* is formed at the first radius 26*a* between the first electrical circuit 22*a* and the electrical ground 21. In a similar manner, the second spark gap 20*b* is part of the second electrical circuit 22*b* and the electrical ground 21 at a second position 25*b* and a second radius 26*b* from the centerline 24. First body portion 111*a* includes a plurality of orifices 12*a* fluidly connecting first pre-chamber 13*a* with a second pre-chamber 13*b*, defined by body portions 111*a* and 111*b*. Second body portion 111*b* will likewise include a plurality of outlet orifices 12*b* fluidly connecting second pre-chamber 13*b* to an exterior of device 110, for instance an engine combustion chamber.

Figure 3:
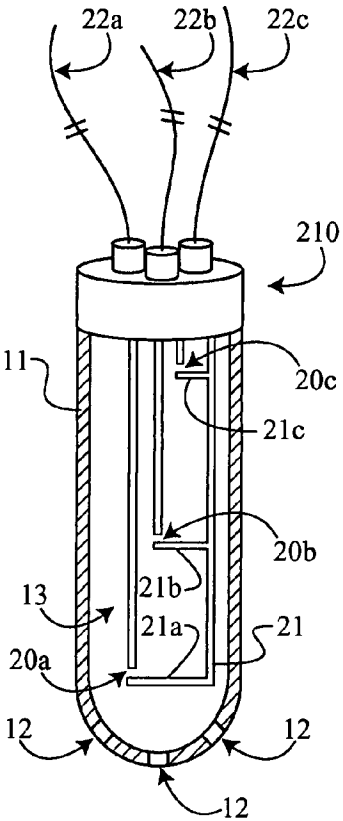
FIG. 3 is a diagrammatic side view of another alternative embodiment of an internal combustion initiation device according to the present disclosure.

FIG. 3 shows a different configuration of an internal combustion initiation device 210 according to the present disclosure where similar elements are assigned similar numbers to previous Figures. In this embodiment, the first electrical circuit 22*a*, second electrical circuit 22*b* and a third electrical circuit 22*c* extend into the prechamber 13. The electrical ground 21 has a first electrical ground lead 21*a*, a second electrical ground lead 21*b* and a third electrical ground lead 21*c*. The first spark gap 20*a* is part of the first electrical circuit 22*a* and the first electrical ground lead 21*a*. In a similar manner, the second spark gap 20*b* is part of the second electrical circuit 22*b* and the second electrical ground lead 21*b*, and the third spark gap 20*c* is part of the third electrical circuit 22*c* and the second electrical ground lead 21*c*.

It will be recognized by those skilled in the art that FIGS. 1, 2 and 3 are merely examples of embodiments of the present disclosure. The particular arrangement of the electrical ground 21, the arrangement of each of the electrical circuits 22*a-c* and their respective distances 27*a-b* from the orifices, the insulation 23 thereof, the particular placement of the orifices 12, 12*a*, 12*b* in the internal combustion initiation device body 11, and other factors easily recognizable to those skilled in the art are not intended to limit the spirit or scope of this disclosure in any way, but merely to provide different contemplated embodiments of the present disclosure.

One alternative embodiment that has not yet been discussed herein could include a first spark gap at a first radius from a given location on the centerline, and a second spark gap at a second radius from the same location on the centerline such that the first and second spark gap are arranged opposite each other at differing radii from the centerline. A further example could include a first spark gap at a first position along the centerline, and a second spark gap at a second position along the centerline such that the first and second spark gaps are linearly aligned with each other along the centerline.

Further, it will be recognized that although only FIG. 2 provides an example of a centerline 24, a first and second location 25*a*, 25*b*, and a first and second radius 26*a*, 26*b*, those elements are implicitly included in FIGS. 1 and 3. It is implied by FIG. 1 that the electrical ground 21 lies on the centerline, while in FIG. 2 no element lies along the centerline. It is further implied that the spark gaps 20*a-c* in FIG. 3 are accordingly a first through third distance, respectively, from the lowermost orifice 12 in a manner similar to FIG. 1. One skilled in the art will also recognize that the number of electrical circuits shown in each example is not intended to be definitive. It is contemplated that any design with at least two electrical circuits 22*a*, 22*b*, each with a respective spark gap 20*a*, 20*b* as described herein, will be appropriately encompassed by the spirit and scope of the present disclosure.

Figure 4:
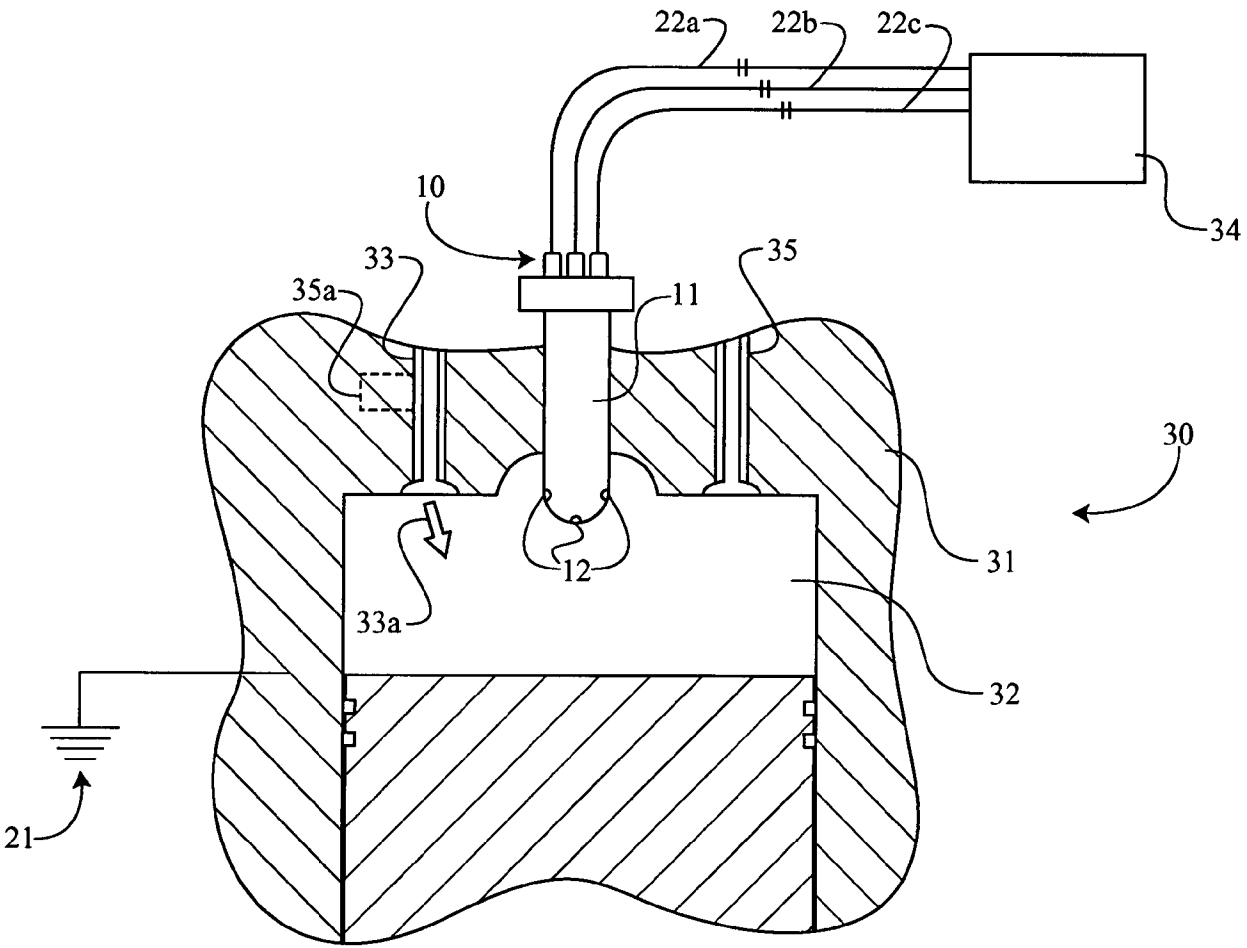
FIG. 4 is a diagrammatic side view of an internal combustion engine including a combustion chamber coupled with an internal combustion initiation device according to the present disclosure.

Referring to FIG. 4, there is shown an internal combustion engine 30 including a housing 31 defining a combustion chamber 32 and including an internal combustion initiation device 10 connected to a plurality of electrical circuits 22*a-c* that are operably controlled by an electronic controller 34 according to the present disclosure. Elements are identically numbered to similar elements in FIGS. 1-3. The internal combustion engine 30 includes a gaseous fuel and air supply passage 33 which introduces fuel and air, illustrated with arrow 33*a*, into combustion chamber 32. A fuel delivery device such as a fuel intake valve or injector 35*a* may open to or extend into passage 33. An exhaust passage 35 is also connected with chamber 32. The internal combustion initiation device 10 includes an internal combustion initiation device body 11 with a plurality of orifices 12 that open from the internal combustion initiation device body 11 into the combustion chamber 32.

One skilled in the art will appreciate that the above example is merely one embodiment of the present disclosure, and several variations are contemplated. The internal combustion initiation device 10 may include at least two electrical circuits 22*a* and 22*b*, and additional circuits such as 22*c* are herein contemplated. It will further be recognized that the "air" could include air from outside the internal combustion engine 30, or air plus exhaust gas, air plus water or some other mixture. Finally, any means for introducing a mixture of gaseous fuel and air or some other type of mixture such as a premixed gasoline and air charge, or a mixture containing water into the combustion chamber 32 are herein contemplated. Examples could include pre-mixing the gaseous fuel and the air to a desired AFR and then introducing the mixture into the combustion chamber 32 via a single supply means, or any other conventional method known to one skilled in the art. For instance, gaseous fuel and air, and possibly recirculated exhaust gas, could be delivered to the engine cylinders via separate passages.

INDUSTRIAL APPLICABILITY

This disclosure contemplates use of the internal combustion initiation device 10 in a variety of internal combustion engines 30 which typically combine an amount of combustible gaseous fuel, such as natural gas, with a relatively large amount of air to form a relatively lean fuel mixture. This disclosure also contemplates the use of exhaust gas recirculation to affect the AFR. By way of illustration only, it is contemplated that the AFR could be on the order of 68:1 under certain operating conditions, though one skilled in the art will recognize that many other ratios and mixtures could be considered a lean fuel mixture. Moreover, it is common in the art to refer to a mixture of air and recirculated exhaust gas as "air" in calculating an AFR. Thus, references herein to a particular AFR should be understood as encompassing the use of reactants and/or diluents other than merely fuel and air. One skilled in the art will also recognize that although this disclosure is designed with gaseous fuel in mind, the use of an atomized liquid fuel such as a petroleum distillate fuel would be appropriately encompassed within the spirit and scope of this disclosure.

Figure 5:
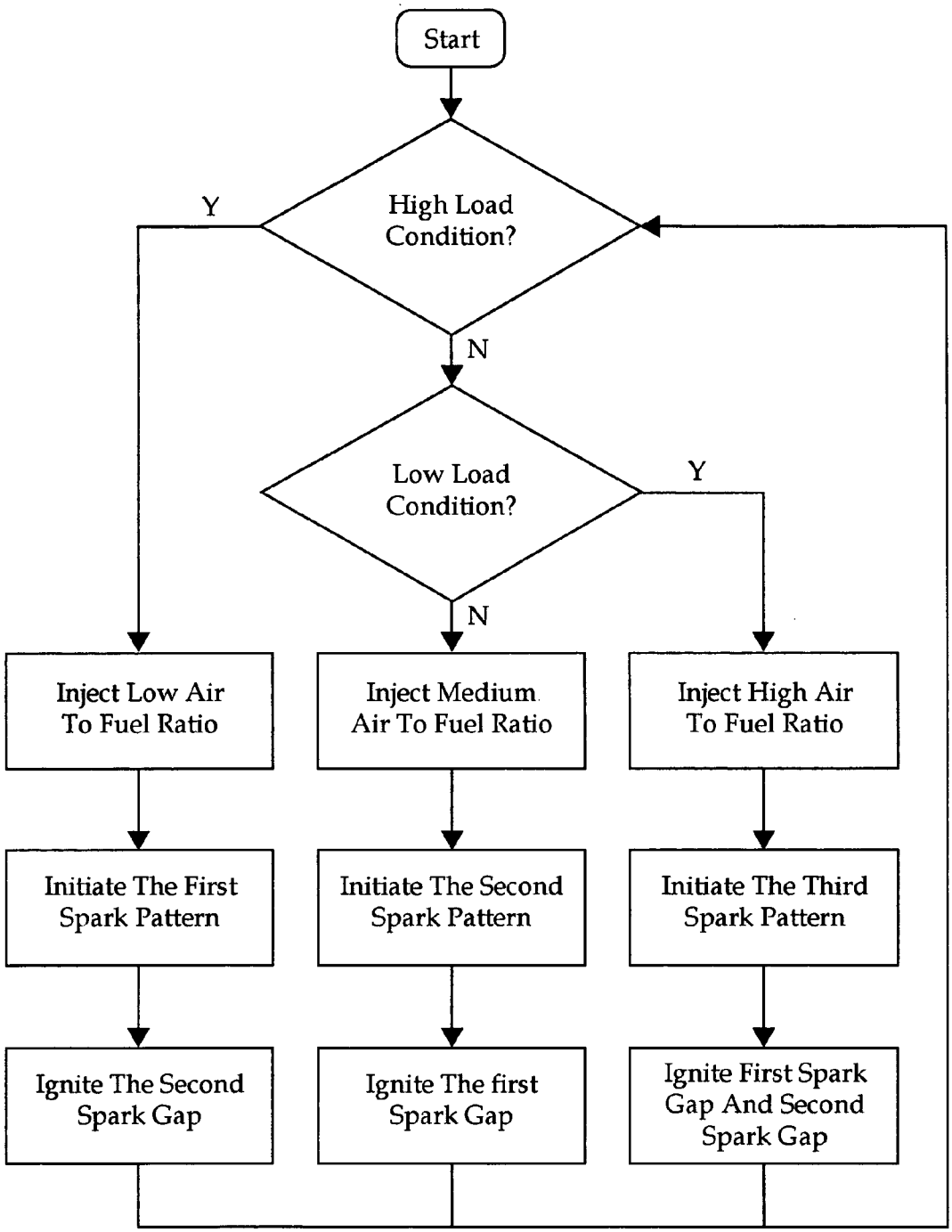
FIG. 5 is a flow diagram illustrating a control process using an internal combustion initiation device, according to the present disclosure.

It is further contemplated that the selected fuel mixture will depend upon the load conditions of the internal combustion engine as in the flow diagram of FIG. 5 discussed herein. FIG. 5 illustrates an exemplary control process according to the present disclosure, including for example the use of an internal combustion initiation device 10 such as that shown in FIG. 1 where the second spark gap 20*b* is at a position 25*b* farther from the orifice(s) 12 than the position 25*a* of the first spark gap 20*a*. This arrangement will result in the internal combustion initiation device 10 being operable to ignite three different spark patterns, described as follows.

A firing event will be called for, and the algorithm for implementing the process will start at step 40. The algorithm may be operable to first determine whether the engine 30 is operating at a high load condition in step 41*a*. If the internal combustion engine 30 is operating at a high load condition, the combustion chamber 32 may be filled with a fuel mixture having an appropriate AFR in step 42*a*. Under high load conditions, the absolute amount of fuel will be larger than for low load conditions, however, in many instances, the mixture will actually be relatively leaner than the mixture used for lower load conditions. The selected AFR may be high in step 42*a*, because either a greater increase in air for a given increase in fuel takes place (as compared to lower load conditions), or because a diluent is added, such as exhaust gas. In either case, the combustion mixture will typically be relatively diluted with respect to fuel. Accordingly, a relatively slow burn at a relatively low temperature may be used to reduce the amount of NOx produced by the engine 30. Because the engine is operating at a high load, initiation of combustion may be relatively easier for a lean mixture than at lower load conditions, as is familiar to those skilled in the art.

From step 42*a*, the electronic controller may then select a first spark pattern of device 10 in step 43*a*, followed by directing the second electrical circuit 22*b* to fire the second spark gap 20*b* in step 44*a*. This will cause a spark to initiate combustion in the prechamber 13 of the internal combustion initiation device body 11 at a second position 25*b*, relatively far from orifices 12. The combustion process will expel a relatively large amount of unburned fuel mixture from the prechamber 13 followed by burning fuel mixture, creating a relatively small flame front and resulting in a relatively slow combustion process inside the combustion chamber 32, in turn resulting in relatively low NOx production. From step 44*a* the process may return to step 40 and repeat.

If it is determined in step 41*a* that the engine is not operating at a high load condition, the algorithm will next determine whether the engine is operating in a low load condition in step 41*b*. If the engine 30 is operating in neither a high nor a low load condition, then the engine 30 is determined to be in a medium load condition. This disclosure also contemplates more or less than the described low, medium and high load ranges. In other words, a multiple spark pattern device according to the present disclosure might be designed having more than three spark gaps, corresponding to more than three load ranges. If there is a medium load on the internal combustion engine 30, then the combustion chamber 32 may be filled with an appropriate fuel mixture in step 42*b*. The fuel mixture may have a medium AFR and medium leanness, though the present disclosure is not thereby limited. The electronic controller 34 will select a second spark pattern in step 43*b*, and thenceforth direct the first electrical circuit 22*a* to fire the first spark gap 20*a* in step 44*b*. This will cause a spark to initiate combustion in the prechamber 13 of the internal combustion initiation device body 11 at a first position 25*a* close to the orifices 12. Burning fuel will enter the combustion chamber 32 from the prechamber 13 before the unburned gasses due to the position 25*a* close to the orifices 12, resulting in a relatively larger flame front as compared to high load operation. From step 44*b*, the process may repeat.

FIG. 5 further demonstrates that if the internal combustion engine 30 is determined in step 41*b* to be at a low load, then the combustion chamber 32 may be filled with a fuel mixture appropriate for low load conditions. As alluded to above, the fuel mixture may be relatively richer than the fuel mixture used for high load operation, though the absolute amount of fuel will be lower. Those skilled in the art will appreciate that richness/leanness of the combustion mixture and the AFR may be substantially varied, through the addition of recirculated exhaust gas, for example. It will then be desirable for electronic controller 34 to select a third spark pattern in step 43*c*, and then direct both the first electrical circuit 22*a* and the second electrical circuit 22*b* to fire their respective spark gaps 20*a*, 20*b* in step 44*c*. In this manner a more thorough combustion reaction may take place in the prechamber 13 leaving almost no unburned fuel mixture, and causing a relatively large amount of burning fuel to enter the combustion chamber 32. This burning fuel will further initiate a desired combustion reaction in the combustion chamber 32 via a very large flame front.

Operation of a system using device 110 of FIG. 2 will be similar to that described above, however, since device 110 includes two pre-chambers, the operation will be somewhat different. For instance, if the spark occurs at spark gap 20*b*, burned gases will be initially ejected out of the upper, top-tilt orifices 12*a* whereas unburned gases will be initially ejected out of the lower, straight orifices 12*a*. Thus, a spark at spark gap 20*b* will not initially ignite gases in the lower part of pre-chamber 13*a*. In contrast, where sparking occurs at spark gap 20*a*, hot burned gases will initially pass via the lower orifices 12*a* into second pre-chamber 13*b*, igniting the gases therein. Thus, whether to command a spark at spark gap 20*b* or 20*a* will depend at least in part on whether it is desirable to initially deliver hot burning gases or unburned gases from first pre-chamber 13*a* to second pre-chamber 13*b*. In some instances, the embodiment of FIG. 2 will allow ignition of substantially all of the gases in second prechamber 13*b* such that the majority of gases ejected from second prechamber 13*b* to a combustion chamber will be hot, burned gases.

Similar control is available with the embodiments of FIGS. 1 and 3. For instance, if it is desirable to initially expel burned gases from device 10 of FIG. 1, the lower spark gap 20*a* could be used. Activation of spark gap 20*b* would initially expel unburned gases, in some instances resulting in a slower combustion process in chamber 32 where used in engine 30, in contrast.

It is contemplated that the exact AFR (or proportion of exhaust gas or other diluent in the combustion mixture), richness, leanness, etc. used for each load condition, and the selection of an electrical circuit 22*a-c* according to the specified load condition will vary depending upon the exact specifications and requirements of the internal combustion engine 30. These variations are implicitly included within the spirit and scope of this disclosure. Further, it will be recognized that the variation of the relative proportions of air, fuel, exhaust gas, etc. in the combustion mixture, as well as spark gap selection could depend upon factors known to those skilled in the art other than load condition of the internal combustion engine 30, such as the placement of the orifices 12 in the internal combustion initiation device body 11.

The advantages of the presently described internal combustion initiation devices will be easily recognizable by one skilled in the art. Rather than having one operating condition where the internal combustion initiation device 10 is optimally efficient, the present disclosure provides a plurality of "optimal" operating conditions. By varying which of the spark gaps 20*a-c* or which spark gap combination creates a spark pattern that ignites a combustion reaction in the prechamber 13, the resulting plume shape and burn state of gas exiting through the orifices 12 can be altered. In this way, the combustion reaction inside the combustion chamber 32 can be maintained within a specific range where NOx production is reduced while the fuel mixture combusts more or less completely.

It will also be apparent to one skilled in the art that the number of possible spark patterns increases exponentially as the number of electrical circuits 22*a-c* increases. As described above, two electrical circuits 22*a*, 22*b*, each with a respective spark gap 20*a*, 20*b* have three different spark patterns. It will be recognized that three electrical circuits 22*a-c*, each with a respective spark gap 20*a-c* will have seven different spark patterns (20*a*, 20*b*, 20*c*, 20*a*+20*b*, 20*a*+20*c*, 20*b*+20*c*, 20*a*+20*b*+20*c*). It is contemplated that this number may be increased readily to create a wide range of efficient operating conditions for the internal combustion engine 30.

It will be recognized that another advantage of the internal combustion initiation device 10 herein disclosed is the ability to add an even greater amount of air 35*a* (or exhaust gas), based at least in part on the selected spark pattern, to the combustion chamber 32 and create an even leaner mixture which will have the benefit of reducing NOx production. In other words, the lean limit of an engine may be extended, as the initiation device can facilitate ignition of relatively leaner mixtures than might otherwise be practicable, and may further influence the burn rate of the combustion mixture to control NOx. It will be understood that by firing all of the spark gaps 20*a-c* simultaneously, a very large flame front can be produced from the orifices 12 in comparison to that which could be produced using conventional internal combustion initiation devices known in the art. The larger flame front can ignite a combustion reaction of a lean mixture that might not otherwise be combustible with a conventional internal combustion initiation device when balanced with a desire for fuel efficiency over a common operating range. In other words, a conventional internal combustion initiation device might be usable at a given AFR, but prohibitively inefficient at normal operating conditions. The internal combustion initiation device 10 herein disclosed will be efficient over a broad range of AFR's and range of exhaust gas diluent proportions given the ability to vary the spark pattern, and hence burned vs. unburned composition of the gases delivered to the combustion chamber of the engine.

The present description is for illustrative purposes only, and should not be construed to narrow the breadth of the present disclosure in any way. Thus, those skilled in the art will appreciate that various modifications might be made to the presently disclosed embodiments without departing from the intended spirit and scope of the present disclosure. Other aspects, objects, and advantages of the disclosure can be obtained from a study of the drawings, the disclosure and the appended claims.

What is claimed is:

1. An internal combustion initiation device comprising:

a body defining a prechamber and a plurality of outlet orifices;

a first spark gap at a first position inside the prechamber coupled with a first electrical circuit;

a second spark gap at a second position inside the prechamber coupled with a second electrical circuit; and the first position of the first spark gap and the second position of the second spark gap are first and second different distances, respectively, from a lowermost orifice of the plurality of outlet orifices.

2. A device as in claim 1 further including at least a third spark gap at a third position, which is different from the first and second positions, inside the prechamber coupled with a third electrical circuit.

3. A device as in claim 1 wherein the body has a centerline; and the first position is at a first radius from the centerline and the second position is at a second radius, which is different from the first radius, from the centerline.

4. A device as in claim 1 wherein the first spark gap and the second spark gap share a common electrical ground.

5. A device as in claim 4 wherein the common electrical ground is a portion of the body.

6. An internal combustion initiation device comprising:

a body defining a prechamber and a plurality of outlet orifices;

a first spark gap at a first position inside the prechamber coupled with a first electrical circuit;

a second spark gap at a second position inside the prechamber coupled with a second electrical circuit;

the first spark gap and the second spark gap share a common electrical ground;

wherein the common electrical ground is a portion of the body; and wherein the prechamber is a first prechamber defined in part by a first body portion, and further comprising a second prechamber defined in part by the first body portion and in part by a second body portion nested with said first body portion.

7. An internal combustion engine comprising:

an engine housing including at least one combustion chamber;

an internal combustion initiation device attached to the engine housing and including a plurality of orifices that open from a prechamber and fluidly connect with the combustion chamber, and means for initiating a selected one of at least two different spark patterns in the prechamber; and the means for initiating includes spark gaps located at least two different distances from a lowermost orifice of the plurality of orifices.

8. An internal combustion engine comprising:

an engine housing including at least one combustion chamber;

an internal combustion initiation device attached to the engine housing and including a plurality of orifices that open from a prechamber and fluidly connect with the combustion chamber, and means for initiating a selected one of at least two different spark patterns in the prechamber from among spark gaps located at least two different distances from a lower most orifice through the prechamber; and wherein the means for initiating at least two different spark patterns includes an electronic controller operably coupled to a first and a second electrical circuit associated with a first and a second spark gap, respectively.

9. An internal combustion engine as in claim 8 wherein the electronic controller is operably coupled to a third electrical circuit associated with a third spark gap.

10. An internal combustion engine as in claim 9, wherein said internal combustion initiation device includes a first body portion wherein said first and second sparkgaps are positioned, and a second body portion nested with said first body portion, another prechamber being defined between said first and second body portions.

11. An internal combustion engine as in claim 8 wherein a first spark pattern includes a first combination of the first spark gap and the second spark gap; and a second spark pattern includes a second combination of the first spark gap and the second spark gap.

12. An internal combustion engine as in claim 8 wherein the electronic controller is operable to ignite a first spark pattern when the internal combustion engine is in a first operating condition; and is operable to ignite a second spark pattern when the internal combustion engine is in a second operating condition.

13. A method of operating an internal combustion engine comprising the steps of:

supplying fuel to a combustion chamber;

selecting one of a plurality of different spark patterns from among spark gaps located at least two different distances from a lower most orifice through the prechamber; and igniting the fuel at least in part by igniting the selected spark pattern inside of a prechamber of an internal combustion initiation device.

14. A method of operating an internal combustion engine comprising the steps of:

supplying fuel to a combustion chamber;

selecting one of a plurality of different spark patterns from among spark gaps located at least two different distances from a lower most orifice through the prechamber;

igniting the fuel at least in part by igniting the selected spark pattern inside of a prechamber of an internal combustion initiation device; and wherein the step of selecting one of a plurality of different spark patterns includes selecting at least one of a plurality of electrical circuits, electrically connected to the internal combustion initiation device.

15. A method of operating an internal combustion engine as in claim 14 wherein the step of selecting the spark pattern based in part upon a load condition of the internal combustion engine includes the step of initiating a spark at a first distance from an orifice of a combustion prechamber when the internal combustion engine is at a high load condition; and initiating a spark at a distance closer to the orifice than the first distance when the internal combustion engine is at a low load condition.

16. A method of operating an internal combustion engine comprising the steps of:

supplying fuel to a combustion chamber;

selecting one of a plurality of different spark patterns from among spark gaps located at least two different distances from a lower most orifice through the prechamber;

igniting the fuel at least in part by igniting the selected spark pattern inside of a prechamber of an internal combustion initiation device; and wherein the step of selecting one of a plurality of different spark patterns includes selecting the spark pattern based in part upon a load condition of the internal combustion engine.

17. A method of operating an internal combustion engine comprising the steps of:

supplying fuel to a combustion chamber;

selecting one of a plurality of different spark patterns from among spark gaps located at least two different distances from a lower most orifice through the prechamber;

igniting the fuel at least in part by igniting the selected spark pattern inside of a prechamber of an internal combustion initiation device; and supplying a quantity of air to the combustion chamber based at least in part on the selected spark pattern.

* * * * *